United States Patent [19]

Ball

[11] 4,423,673

[45] Jan. 3, 1984

[54] APPARATUS FOR PREDRAPING STRAPPING ABOUT AN ARTICLE TO BE STRAPPED

[75] Inventor: Richard I. Ball, Round Lake, Ill.

[73] Assignee: Signode Corporation, Glenview, Ill.

[21] Appl. No.: 384,218

[22] Filed: Jun. 2, 1982

[51] Int. Cl.[3] ..... B65B 13/10

[52] U.S. Cl. ..... 100/28; 100/3; 100/33 PB; 156/502

[58] Field of Search ..... 100/2, 3, 4, 27, 28, 100/29, 33 PB; 156/73.5, 494, 502

[56] References Cited

U.S. PATENT DOCUMENTS

| | | | |
|---|---|---|---|
| 1,875,260 | 8/1932 | Parker | 100/28 |
| 2,608,150 | 8/1952 | Cranston | 100/27 |
| 2,705,914 | 4/1955 | Cranston | 100/28 |
| 2,920,553 | 1/1960 | Van Marle | 100/27 |
| 3,324,789 | 6/1967 | Buettner | 100/27 |
| 3,548,740 | 12/1970 | Kobiella | 100/28 |
| 3,665,845 | 5/1972 | Lyon | 100/27 |
| 3,771,345 | 11/1973 | Vascotto et al. | 100/4 |
| 4,153,499 | 5/1979 | Annis | 100/28 X |

*Primary Examiner*—Billy J. Wilhite

*Attorney, Agent, or Firm*—Dressler, Goldsmith, Shore, Sutker & Milnamow, Ltd.

[57] ABSTRACT

Apparatus for forming a loop of strap about a package in which the strap is initially draped about the package in spaced relationship therefrom. Included is a clamping bar assembly which includes a package engaging member and a pair of spaced catch blocks over which the strap is draped. The catch blocks are rotatably mounted relative to the clamp bar assembly and are operated through the action of rack and pinion assemblies that respond to the movement of the package engaging member. When the package is engaged, the catch blocks release the strap normally guided thereby and when the clamp bar is retracted, the catch blocks are repositioned to guide a subsequent loop of strap.

4 Claims, 8 Drawing Figures

FIG. 3
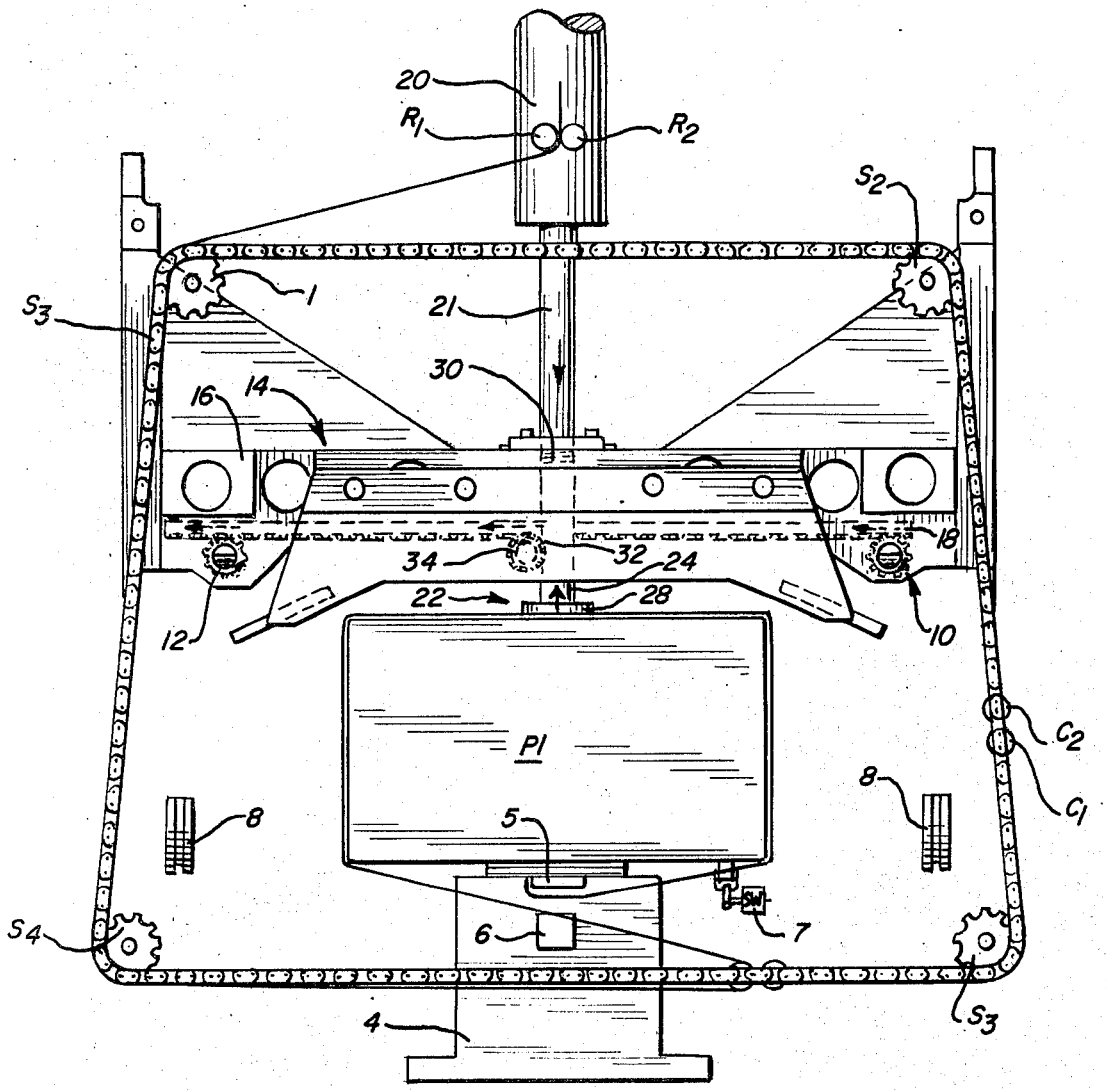
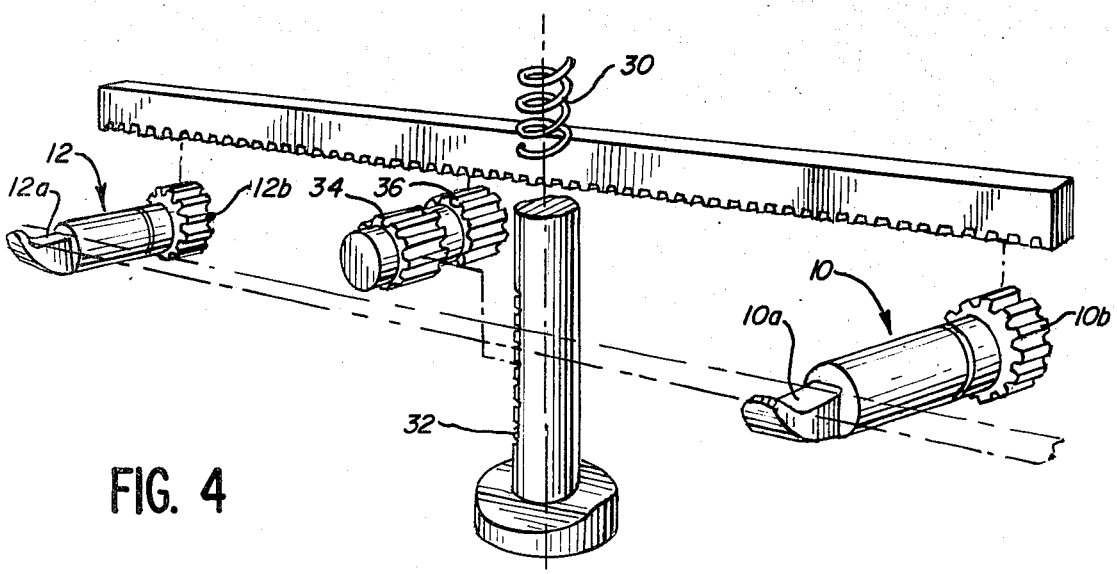
FIG. 4

FIG. 5
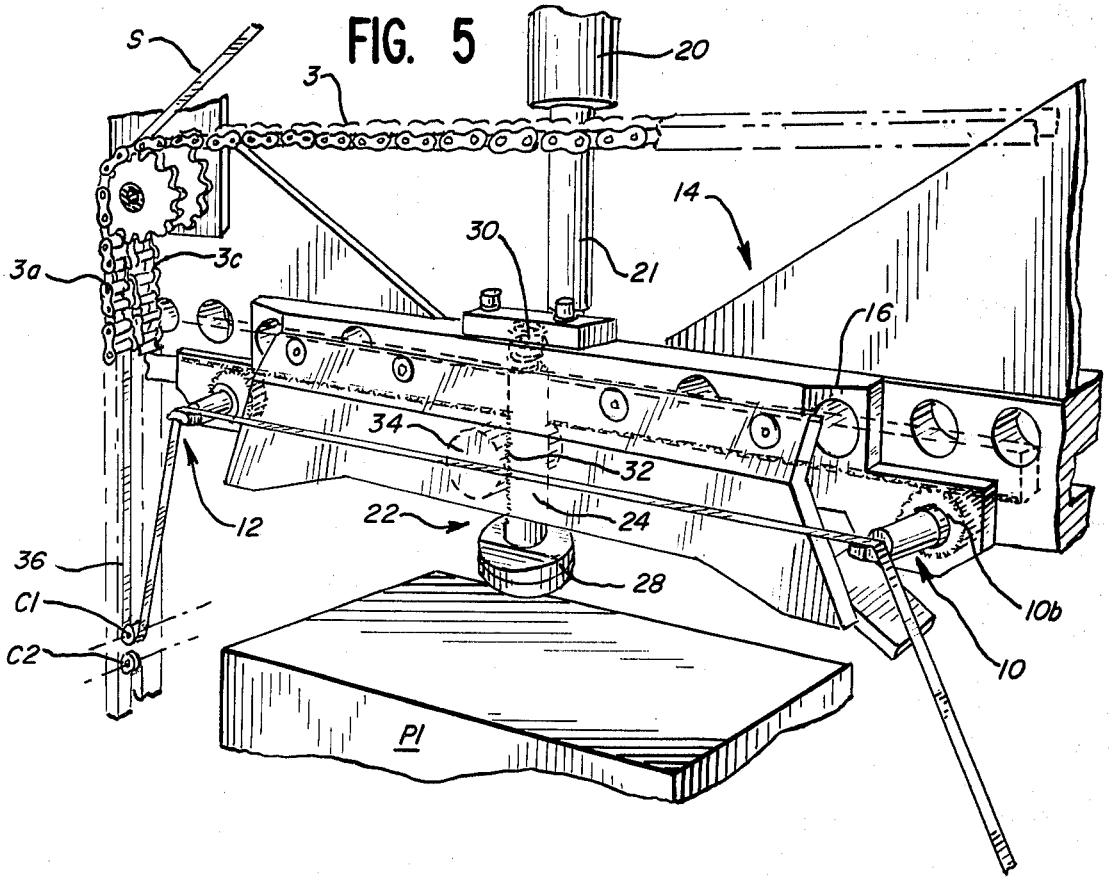
FIG. 6
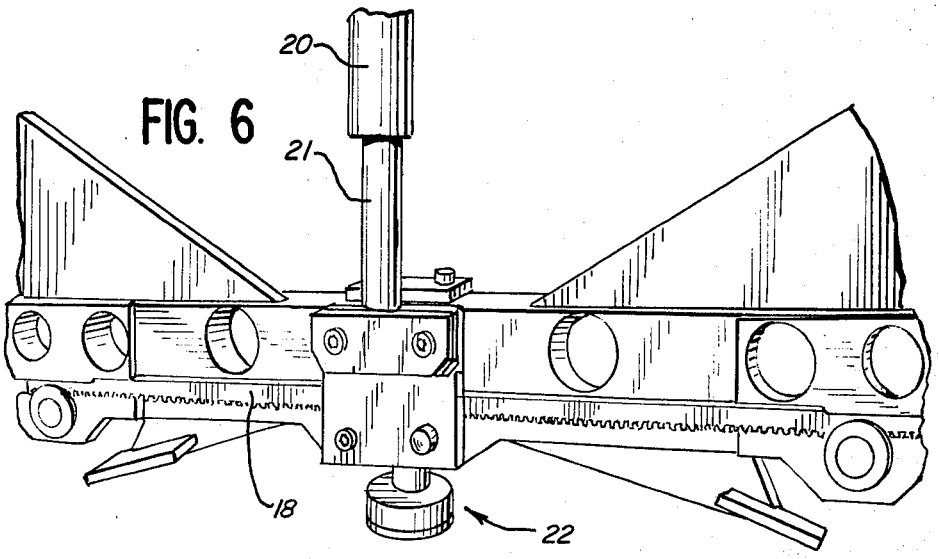
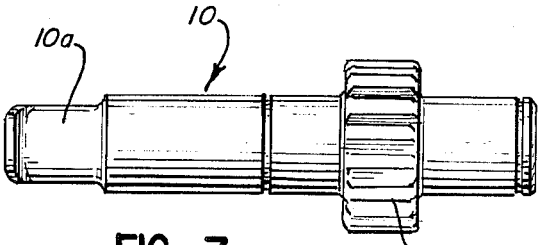
FIG. 7
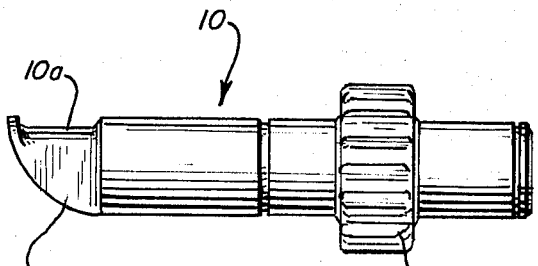
FIG. 8

APPARATUS FOR PREDRAPING STRAPPING ABOUT AN ARTICLE TO BE STRAPPED

TECHNICAL FIELD

This invention relates to an apparatus where a length of binding such as plastic strapping is drawn from a source and is encircled about an article to establish a closed tensioned loop having overlapping end portions which are subsequently joined by suitable means such as a friction-fusion seal.

BACKGROUND OF THE INVENTION

There are currently available chuteless machines where bindings such as strap is unwound from a source while the leading end of the strap is gripped adjacent the package and the trailing portion is moved around the article. In order to facilitate high-speed operation, it is desirable to predrape or dispose the strap substantially about the package before the package is introduced into the package receiving station. When this occurs, obviously the amount of time subsequently necessary to complete the strapping about the package is substantially minimized.

In an application assigned to the present invention entitled "Method and Apparatus for Predraping an Object Receiving Station With Flexible Binding," Ser. No. 261,969, filed May 8, 1981 (hereinafter referred to as Ser. No. 261,969) such a predraping method and apparatus has been disclosed. However, while this arrangement has been satisfactory, there appears to be a need to provide an improved arrangement for facilitating release of the strap from the upper portion of the predraping mechanism prior to completion of the tensioning and sealing operations of the strap. By providing an improved mechanism for releasing the strap from the upper strap guide assembly, the overall operation of the strapping system can be substantially improved.

SUMMARY OF THE INVENTION

An apparatus is provided for predraping a loop of flexible binding about objects positioned seriatim in an object receiving station. The apparatus includes means for restraining an end of the binding at the receiving station adjacent an object to be received therein and then pulling the trailing portion of the binding in a path around the object. The apparatus includes means for initially pulling the trailing portion of the binding through a major portion of the locus of a path around the receiving station. The apparatus has guides spaced inwardly of the path for guiding and retaining the binding in a configuration spaced outwardly of the receiving station.

According to a preferred embodiment, after a first object is bound in the receiving station by the apparatus, and before a second object is positioned in the receiving station, the apparatus is operated to initially "predrape" or pull the trailing portion of the binding through the major portion of the locus of the path around the receiving station where it is held outwardly of the receiving station by the guides.

After commencing this "predraping" at the receiving station with a portion of binding, a bound first object is removed from the receiving station and a second object is moved into proper position in the receiving station. Thus by the time the second object has been properly positioned in the receiving station, the "predraping" of the receiving station with the binding has been completed so that the binding need only be pulled a relatively small additional distance around the second object and then tightened thereabout. To this end, the guides are release the outwardly spaced length of binding and at the same time, the binding is further pulled to complete the path and then form a tensioned loop about the second object.

In the present novel apparatus, the release of the strap from the mechanism carrying the strap over the top of the package is accomplished by a novel gear and rack mechanism responsive to contact with the upper surface of the package which serves to release the strap from the upper guides initially provided to retain the strap in position above and out of interference with the package being introduced into the article binding station.

BRIEF DESCRIPTION OF THE DRAWINGS

The accompanying drawings form part of the specification in which like numerals are employed to designate like parts throughout the same.

FIG. 3 is a related diagramatic view similar to FIG. 1 and showing the strap carrier having moved counterclockwise around the receiving station with the strap released by the guide members and drawn around a package;

FIG. 4 is an exploded perspective view showing the upper catch blocks and the mechanism for operating same;

FIG. 5 is a perspective view partially broken away showing the upper portion of the predraping assembly and the chain drive therefor;

FIG. 6 is a perspective view of a portion of the upper section of the predraping assembly; and FIGS. 7 and 8 are two views of the upper catch blocks.

DESCRIPTION OF THE PREFERRED EMBODIMENT

Figure 1:
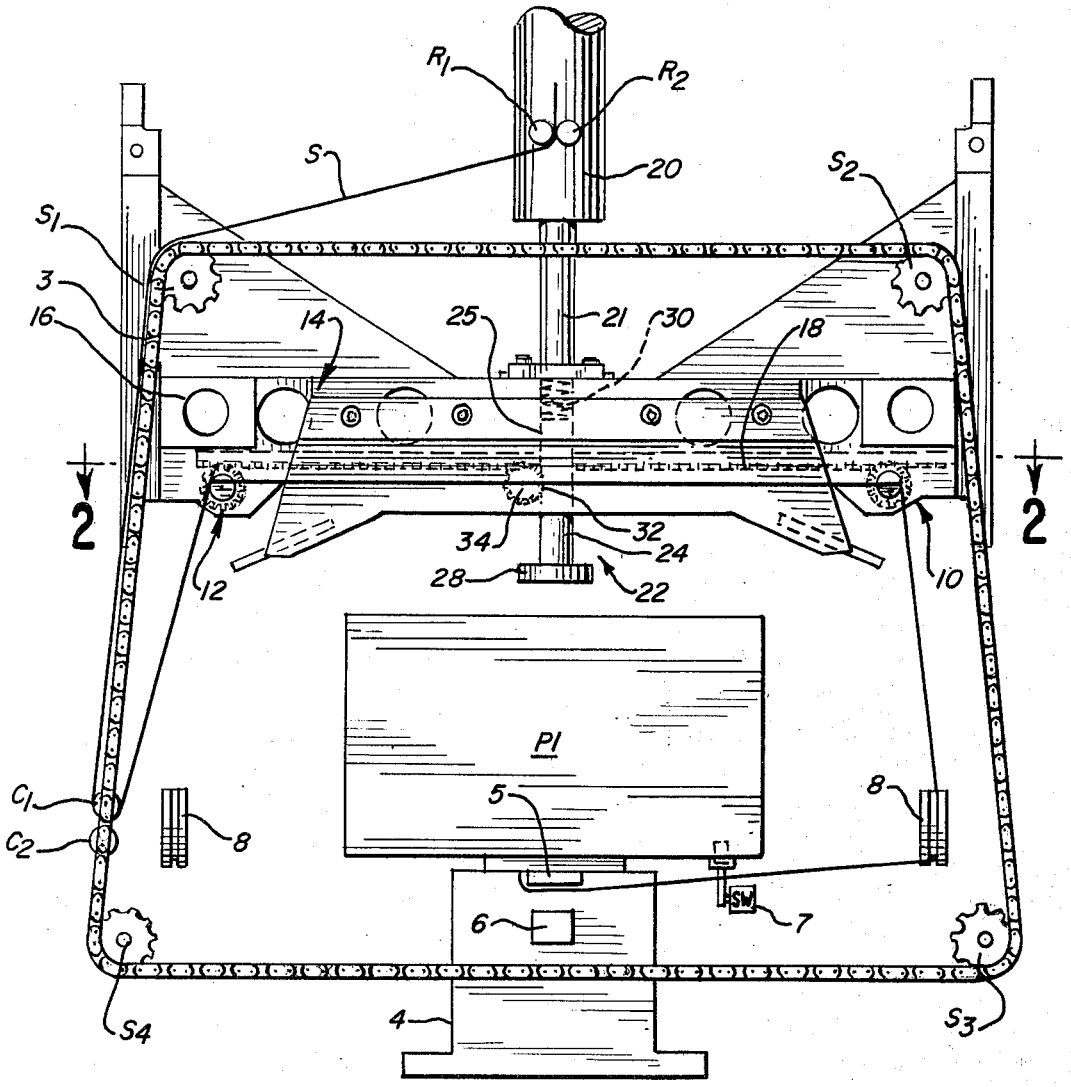
FIG. 1 is a fragmentary diagrammatic view of a strapping apparatus utilizing a chain driven carrier for draping a loop of strap about a package and showing the carrier and strap at an initial position at the start of the cycle.

While this invention is susceptible of embodiment in many different forms, there is shown in the drawings and will herein be described in detail a preferred embodiment of the invention. It will be understood, however, that the present disclosure is to be considered as an exemplification of the principles of the invention, and is not intended to limit the invention to the embodiment illustrated.

The precise shapes and sizes of the components herein illustrated are not essential to the apparatus unless otherwise indicated.

It will be understood that the apparatus disclosed herein has certain conventional mechanisms, including drive mechanisms, control mechanisms, strap sealing mechanisms, and the like, the details of which, though not fully illustrated nor described, will be apparent to those having skill in the art and an understanding of the necessary functions of such mechanisms.

For ease of description, the apparatus disclosed herein will be described in the normal operating position, and terms such as upper, lower, horizontal, and so forth, will be used with reference to normal operating positions. It will be understood, however, that the apparatus may be manufactured, stored, transported, and sold in an orientation other than the normal operating position described.

The novel apparatus disclosed in the instant application is illustrated as a modification of existing strapping machines manufactured and sold by Signode Corporation, 3600 West Lake Avenue, Glenview, Ill. USA, and illustrated in U.S. Pat. No. 3,548,740 and U.S. application Ser. No. 261,969.

In this description, only such portions of the mechanisms disclosed in aforementioned U.S. Pat. No. 3,548,740 and U.S. appln. Ser. No. 261,969 as are relevant to the present apparatus have been illustrated, those portions being described only in sufficient detail as to afford an understanding of its relation to the novel apparatus disclosed herein. However, the entire disclosure of the U.S. Pat. No. 3,548,740 and U.S. appln. Ser. No. 261,969 insofar as it is consistent with the present disclosure is hereby incorporated in and made a part of the present disclosure by reference thereto. Such modifications as are necessary to adapt the novel apparatus of this invention to either of the machines disclosed in U.S. Pat. No. 3,548,740 or that disclosed in U.S. appln. Ser. No. 261,969 are described in detail hereinafter.

Referring to FIG. 1, the machine embodying the present invention includes a conventional strap carrier comprising a pair of spaced apart rollers C1 and C2 which define a pass-through region for the strap S which rollers are mounted to a conventional multiple strand type chain 3 which generally encompasses a package receiving station occupied by package P1. As schematically illustrated in FIG. 5, the chain 3 comprises a center strand *3b* between two outer strands *3a* and *3c*. The carrier rollers C1 and C2 are mounted in the center strand *3b*.

The chain 3 is mounted around the package receiving station on a plurality of conventional pairs of spaced apart sprockets which sprockets include at least upper corner sprocket pairs S1 and S2 and lower corner sprocket pairs S3 and S4. Additional sprockets are typically provided especially adjacent sprocket pairs S3 and S4 that are not shown for purposes of simplicity.

The two outer chain strands *3a* and *3c* engage the sprocket teeth of the sprocket pairs S1, S2, S3 and S4. The center strand is not engaged by any sprocket and rides free between the two outer strands. The strap S passing through the carrier rollers C1 and C2 thus has a portion which is guided over the outside of the chain center strand *3b* and a leading portion which passes inside of the center strand *3b* so as to be free to be wrapped tight about the package while the portion of the strap outside of the chain center strand *3b* is continually maintained spaced away from the package.

The sprocket pairs S1, S2, S3 and S4 are typically mounted to a suitable frame (not illustrated) that is provided around the package receiving station. One or more of the sprockets are driven intermittently in one direction or the other by suitable conventional means (not illustrated) to move the chain, and hence the strap carrier rollers C1 and C2 about the package receiving station.

In the three strand chain system illustrated herein, a representative illustration of the pairs of sprockets located about the periphery of the package receiving station is shown in the upper left-hand corner of FIG. 5.

An object to be strapped, such as package P1, is supported in the object or package receiving station on a suitable support structure 4 which includes a conventional anvil 5 arranged to receive the free end of the strap S in underlying relation. The structure 4 also includes a sealer 6 positioned beneath the anvil 5 for movement into working position after an overlapping strap layer is formed beneath the strap free end upon completion of the strap draping and tensioning movement of the carrier rollers.

The support structure 4 includes, among other things, (1) additional grippers (not illustrated) for gripping the free end of the strap for holding strap tension, (2) suitable sealing mechanisms (not illustrated) and (3) strap severing mechanisms (not illustrated). The package support structure 4 and the various mechanisms included therein, though not illustrated in detail in the patent disclosure, may be of suitable conventional designs. Examples of suitable designs are those disclosed and illustrated in the aforementioned U.S. Pat. No. 3,548,740. Any suitable designs may be used with the apparatus and specific designs of these mechanisms form no part of the present invention.

FIG. 1 illustrates the apparatus in an initial position ready to commence an operation cycle to strap the package P1 located in the package receiving station with the strap S but just before it is in final position therein when it would engage switch 7 which would actuate certain mechanisms to move them to the position shown in FIG. 3. The strap free end having been severed from a loop of strap around a previously bound package is gripped by conventional gripper means (not shown) against the anvil 5 at the package support structure 4 beneath the package P1.

The strap S extends outwardly (to the right as viewed in FIG. 1) around a lower corner catch block 8 which maintains the strap spaced away from the bottom of the package P1 and the package receiving station. The catch block 8 may be of any suitable conventional design. A number of designs are currently in commercial use for the lower corner catch blocks 8. Some catch blocks have no moving parts and are said to be "passive". Other catch blocks have moving parts and are said to be "active". For the purposes of this invention, it is assumed that various types of lower catch blocks can be used such as those described and illustrated in patent appln. Ser. No. 261,969.

The present invention relates to the operation and construction of the upper catch blocks which will be described in detail hereinafter. The design construction and operation of the lower catch blocks are such as to initially guide the strap to a spaced position from the package and then release the strap to permit the strap to be drawn and tensioned about the package. As aforementioned, these catch blocks function to facilitate predraping of the strap about a package prior to its being introduced into the station where the strapping is to be wrapped about the package. The mechanisms for controlling the operation of the lower catch blocks 8 are suitable operated at the proper time to facilitate the desired strapping action.

Essentially, as shown in FIG. 1, when the strap is placed in the predraping position, it has been gripped relative to the anvil 5 and then moved about the lower catch block 8 and then directed about the two upper catch blocks 10, 12 and then down the opposite side of the package to be strapped. As can be seen from the drawings, the strap has been predraped about substantially 80 percent of the package to be strapped. The mechanisms for controlling the catch block 8 are conventional and specific designs per se form no part of the present invention.

Continuing the description of the initial strap position as illustrated in FIG. 1, it is seen that strap S extends upwardly from the lower right-hand corner catch block 8. The strap S is still spaced outwardly of the package receiving station and extends to a clamp bar assembly 14 which is reciprocatably mounted to a machine frame (not illustrated) in a conventional manner to accommodate movement of the clamp bar assembly 14 upwardly and downwardly relative to the frame and package P1. The clamp bar assembly 14 includes the novel upper catch block actuation means to be described in detail hereinafter.

The clamp bar assembly 14 is moved between the fully retracted or elevated position illustrated in FIG. 1 to the lowered position against package P1 as illustrated in FIG. 3 by a cylinder 20 having a rod member 21 secured to the upper portion thereof.

Figure 2:
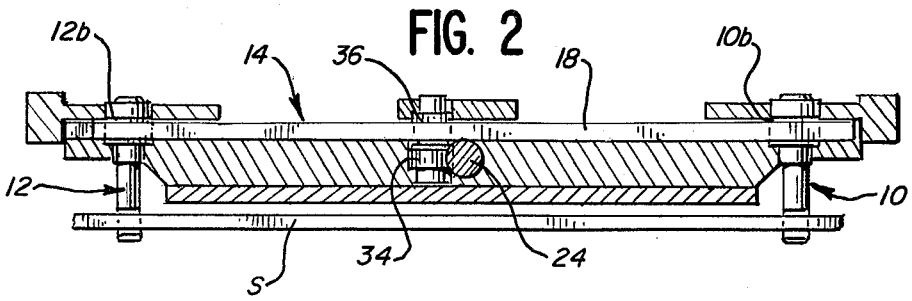
FIG. 2 is a view taken generally along the plane 2—2 of FIG. 1.

In accordance with the present invention, the clamp bar assembly 14 includes a generally horizontally disposed clamp bar frame 16 to which the upper catch blocks 10, 12 are rotatably secured and over which the strap S passes (see FIG. 2). Specifically, when the machine is in the initial position as illustrated in FIGS. 1 and 5, the strap S passes upwardly from the lower right-hand corner catch block 8 over catch blocks 10, 12 located below the drive chain 3 extending between sprocket pairs S1 and S2. The upper catch blocks 10, 12 define grooved strap receiving portions 10*a*, 12*a* at one end thereof and adjacent their other ends are located pinion gears 10*b*, 12*b*. The portions of the blocks below the grooves 10*a*, 12*a* are surfaces 10*c*, 12*c* curved toward the grooved portions for reasons to be described hereinafter. Located within the clamp bar frame 16 is a rack 18 that is mounted to permit limited reciprocal movement thereof relative to the clamp bar frame 16. This rack 18 acts to rotate the catch blocks 10, 12 when it is desired to release the strap from these catch blocks, which method of operation will be described hereinafter. As shown in FIG. 1, the strap S extends over the top of the catch blocks 10, 12 and then downwardly to the chain carrier rollers C1 and C2. At the carrier rollers C1 and C2, the strap S is trained around carrier roller C1 and passes back upwardly around the clamp bar assembly 14 on the outside of the chain 3 around sprocket pair S1. From there the strap passes to a pair of centering rollers R1 and R2.

The spaced apart centering rollers R1 and R2 allow for feeding of the strap in either wrapping direction around the package P1 and the package receiving station. The rollers R1 and R2 are affixed to a suitable support or frame (not illustrated).

The strap S enters a space between the rollers R1 and R2 from a supply of strap, such as a reel of strapping and preferably from a strap dispensing and storing station, system or mechanism (not illustrated). Preferably such a strap dispensing and storing mechanism has facilities whereby during initial application of a loop, relatively light tension is applied which will not dislodge the loosely positioned package P1 and whereby, after the loop is completed, a high degree of tension becomes effective to draw the loop tight around the package P1 immediately prior to the loop sealing operation. An example of one such strap dispensing and storing mechanism is illustrated and described in U.S. Pat. No. 4,153,499 and is designated in FIG. 1 of that patent generally by reference characters DS.

Up to this point, the predraping system has been described wherein a strap has been predraped around substantially 80 percent of the package, but the strap is maintained spaced from the package. After the package is received in the packaging station it contacts the switch 7 and the clamp bar assembly is moved downwardly through the action of the cylinder 20 operated in response to the actuation of the switch 7 to the position as shown in FIG. 3 where the package contacting member 22, reciprocably supported by the clamp bar frame 16, contacts the package P1. The contacting member 22 has a generally cylindrical main body portion 24 slidably received in a generally cylindrical bore 25 in the clamp bar frame 16. The member 22 has a package contacting flange 28 at its bottom end. The contacting member 22 is normally spring-biased downwardly by spring 30 to the position illustrated in FIG. 1.

In accordance with the novel aspects of the present invention, the engagement of the package contacting member 22 with the package operates the upper catch blocks 10, 12 to release the predraped strap from the clamp bar assembly 16 to permit the strap to be tensioned about the package. To accomplish this, the main body portion 24 of the contacting member 22 is provided with a rack section 32 as shown in detail in FIG. 4. In engagement with the main body portion 24 and rotated thereby is a journaled double pinion 34, 36 which is rotatably supported by the clamp bar assembly 14 as shown in FIG. 2. The movement of the rack 32 rotates pinion 34, and rotation of pinion 34 carries with it pinion 36 which is in driving-engagement with rack 18. Thus it can be seen that in the position shown in FIG. 1 the relative position between the contacting member 22 and the clamp bar assembly 14 through the action of the rack 32 and gears 34, 36 moves the rack 18 to position the upper catch blocks 10, 12 to the position shown in FIG. 1. As shown clearly in FIG. 5, the catch blocks are in the predraping condition, the grooves 10*a*, 12*a* are disposed upwardly to receive and guide the strap and retain the strap in position relative to the clamp bar assembly. This novel unique arrangement provides a simple arrangement for releasing the strap from the upper catch blocks when the clamp bar assembly is in position against the upper part of the package P1 to be strapped. It can be seen that when the clamp bar is returned to its upward normal position by the action of a conventional control mechanism for removal of the package from the package receiving station, the spring 30 will return the contacting member 22 to its lower position and thus through the action of the rack 32, gears 34, 36, rack 18 and pinions 10*b*, 12*b*, the upper catch blocks will be returned to the strap receiving position shown in FIG. 5. It is to be noted that when the catch blocks are rotated, the strap is free to move off the downwardly directed curved surfaces 10*c*, 12*c* of the catch blocks and thus are released therefrom.

In operation, the machine functions as follows. First the package P1 is moved into position in the object or package receiving station on top of the package support structure 4 where it contacts switch 7 which activates cylinder 20. The package P1 may be properly positioned either after the machine mechanisms have assumed the initial positions illustrated in FIG. 1 or during the movement of the machine mechanisms to those positions illustrated in FIG. 1.

In any case, the strapping cycle begins with the machine mechanisms at least in the positions illustrated in FIG. 1 and with the package P1 properly positioned at the object or package receiving station on the support 4 as illustrated in FIG. 1. When the carrier rollers C1 and C2 eventually move from the initial position and pass around the sprocket pair S4, a portion of the strap will remain inwardly of the chain to complete the loop around the package while the trailing portion is maintained by chain 3 outwardly of the package P1.

Before the carrier rollers C1 and C2 begin to move in a counterclockwise direction around the package P1, the clamp bar assembly 14 has moved to the downward position against the package P1 by actuation of the cylinder 20 as a result of the package's engagement with switch 7. The clamp bar 16 holds the package P1 tight against the support structure 4 to prevent the package P1 from being moved by the strap S when the strap is later tensioned in a tight loop about the package. Before the clamp bar 16 contacts the package P1, the contacting flange 28 of the package contact member 22 contacts the package and moves upwardly against the action of the spring 30.

As the clamp bar assembly 14 is moved downwardly relative to the contacting member 22, the double pinion 34, 36 rotatably supported by the clamp bar assembly is rotated in a counterclockwise direction by the upward movement of the rack 32. Counterclockwise movement of the pinion 36 moves the rack 18 to the left to rotate the pinions **10*b*, 12*b* secured to the catch blocks 10, 12 in the counterclockwise direction to release the strap from these upper catch blocks. With the strap S no longer being restrained by the upper catch blocks, they are free to be pulled against and around the package when the carrier rollers C1 and C2 are next moved by chain 3 as illustrated in FIG. 3** (in a counterclockwise direction about the package receiving station).

With reference to FIG. 3, it should be noted that both the right-hand catch block 8 and the left-hand catch block 8 are not effective to hold the strap S away from the package as the strap is fed in the counterclockwise direction to complete the loop about the package P1. It is again noted that the lower catch blocks form no part of this invention and that they are suitably designed and/or operated to release any strap that may be engaged thereby at the appropriate time. If further information is required regarding catch blocks of this type, reference is made to the aforementioned U.S. Pat. No. 3,548,740 and U.S. appln. Ser. No. 261,969.

FIG. 3 illustrates, in broken lines, the movement of the carrier rollers C1 and C2 to the extreme counterclockwise position at the point where maximum tension in the strap loop is applied. At this point, the overlapping strap ends are joined by a suitable mechanism, such as by the friction-fusion mechanism or sealer described and illustrated in great detail in the aforementioned U.S. Pat. No. 3,548,740.

Following the sealing of the overlapping strap ends, the trailing portion of the strap is severed by a suitable mechanism (not illustrated). One such suitable strap severing mechanism is disclosed in the above-referenced U.S. Pat. No. 3,548,740 with reference therein to the cutter blade 40.

It remains to note that after the loop of strap has been sealed about the package and then severed from the trailing portion of the strap, the chain 3 is driven in the opposite direction to begin predraping the package receiving station with the strap. When the clamp assembly is retracted, the package contact member is spring biased outwardly. This movement of rack 32 moves the pinions 34, 36 in a clockwise direction which moves rack 18 to the right. This action rotates the pinions **10*b*, 12*b* clockwise to move the upper catch blocks to the position shown in FIG. 1** to receive the strap being draped thereover and retain the strap out of the way of the package to be introduced into the package receiving station.

As the strap is continued to be predraped about the package receiving station, the previously bound package may be moved out of the package receiving station either by hand or automatically. Also, as the package receiving station is continuing to be predraped by the strap S, the next or second package P2 may be moved by hand or automatically into proper positon in the package receiving station on the package support structure 5. To this end, the chain moves the carrier rollers C1 and C2 to the prescribed predraped initial position, and thus the machine is ready to immediately strap the next package P2 from the predraped configuration providing a savings in time and greatly speeding up the overall rate when a plurality of packages are to be strapped seriatim.

Preferably, the predraping of the package receiving station by the carrier rollers C1 and C2 occurs within a fraction of a second after severing the strap from the previously bound and sealed package P1. The apparatus is then in the initial position for strapping the next package P2 before the next package is even located in the package receiving station.

To strap the next package P2, the strapping cycle described above is repeated, in the opposite direction starting from the new initial position. The next cycle will be effective in the opposite direction (clockwise as viewed in FIG. 1) to tighten the loop about the package P2. Upon completion of the strapping of the package P2, the strap carrier rollers C1 and C2 would be in the first predraped initial position identical to that illustrated in FIG. 1.

It will be readily observed from the foregoing detailed description of the invention and the illustrative embodiment thereof that numerous variations and modifications may be effected without departing from the true spirit and scope of the novel concept and principles of this invention.

What is claimed is:

1. A chuteless apparatus for forming a loop of flexible binding about an object positioned in an object receiving station, said apparatus having means for restraining an end of said binding adjacent said receiving station, means for pulling a trailing portion of the binding in a path around said object, means for sealing the loop, a clamp bar assembly including an object contacting member carried by said clamp bar assembly adapted to contact an object in said receiving station and means for moving said clamp bar assembly between an elevated position spaced above said object receiving station and a lowered position contacting said object to hold said object in said object receiving station, and means for then severing the sealed loop from the rest of the binding, said apparatus characterized by the improvement comprising;

means for continuing said pulling of a trailing portion of said binding after binding a first object, said means for continuing said pulling of the binding including means for pulling the binding through a major portion of the locus of said path around said receiving station, and means for temporarily guiding spaced portions of said binding around said receiving station to temporarily retain the binding in a configuration spaced outwardly of said receiving station for a major portion of the locus of said path, said guiding means including spaced catch block assemblies rotatably mounted within said clamp bar assembly and gear means interconnecting said object contacting member and catch block assemblies to rotate said catch block assemblies to release the binding therefrom when the object contacting member contacts the object to be bound.

2. The apparatus as set forth in claim 1 in which the object contacting member is normally spring-biased outwardly and the interconnecting gear means includes a plurality of rack and pinion assemblies operable in response to the reciprocating movement of said object contacting member.

3. The apparatus as set forth in claim 2 in which the object contacting member defines a rack portion and cooperating pinion and the clamp bar assembly contains a reciprocably mounted rack and the catch block assemblies each include a pinion portion whereby when the object contacting member contacts an object the rack in said clamp bar assembly is repositioned to rotate said catch block assemblies to release the binding previously guided thereby.

4. The apparatus as set forth in claim 1 in which the catch block assembly each defines a groove portion for guiding the strap and an oppositely disposed curved section whereby when the catch block is rotated the strap be free to be withdrawn therefrom when the binding is to be tensioned around the object.

* * * * *